United States Patent [19]

Hanlet

[11] Patent Number: 4,675,577

[45] Date of Patent: Jun. 23, 1987

[54] ELECTRODELESS FLUORESCENT LIGHTING SYSTEM

[75] Inventor: Jacques M. Hanlet, Loxahatchee, Fla.

[73] Assignee: Intent Patents A.G., London, England

[21] Appl. No.: 723,194

[22] Filed: Apr. 15, 1985

[51] Int. Cl.[4] ..... H05B 41/16; H05B 41/24

[52] U.S. Cl. ..... 315/248; 315/344; 315/70; 336/229

[58] Field of Search ..... 315/248, 344, 338, 70; 336/229; 156/169

[56] References Cited

U.S. PATENT DOCUMENTS

| | | | |
|---|---|---|---|
| 2,179,601 | 11/1939 | Smith | 315/338 |
| 2,506,026 | 5/1950 | Kifer et al. | 156/169 |
| 4,171,503 | 10/1979 | Kwon | 315/248 |
| 4,414,492 | 11/1983 | Hanlet | 315/98 |
| 4,427,922 | 1/1984 | Proud et al. | 315/248 |

*Primary Examiner*—David K. Moore
*Assistant Examiner*—Theodore C. Salindong
*Attorney, Agent, or Firm*—Morton J. Rosenberg

[57] ABSTRACT

An electrodeless lighting system (10) is provided for converting electromagnetic energy whose spectrum is within the ultraviolet bandwidth into energy within the visible bandwidth of the electromagnetic spectrum through excitation of fluorescent composition coatings (20). The lighting system (10) provides for an excitation mechanism (12) which generates an enclosed magnetic field, an induced electrical field, and a radiating electrical field, where the induced electrical field is substantially parallel and in the same direction as the magnetic field. Both the magnetic and induced electrical fields are applied at substantially the same frequency for accelerating and directing electrons for collision with gas composition atoms contained within a closed contour gas housing (14) and in particular within a gas housing chamber (16). An electrostatic shield (26) substantially encompasses the excitation mechanism (12) is provided for containing the radiating electrical field within the lighting system (10). A bulb member (22) encompasses the electrostatic shield (26) and the excitation mechanism (12). Gas composition atoms which are ionized within the gas housing chamber (16) by collision with accelerated electrons provide for ultraviolet radiation which passes through the substantially transparent excitation mechanism (12), the electrostatic shield (26) and impinges on the coating (20) to re-radiate electromagnetic radiation in the visible portion of the electromagnetic spectrum.

40 Claims, 6 Drawing Figures

FIG. 1
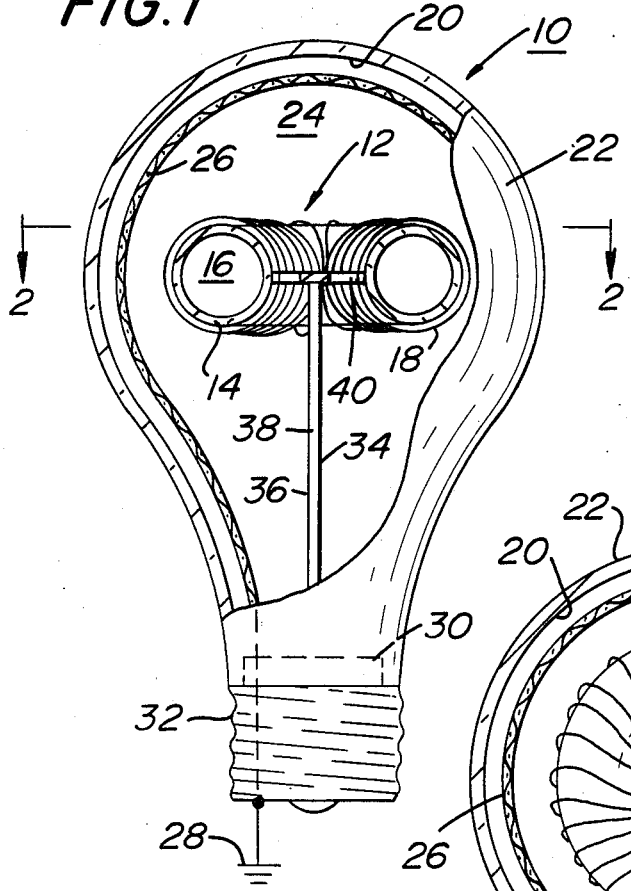
FIG. 2
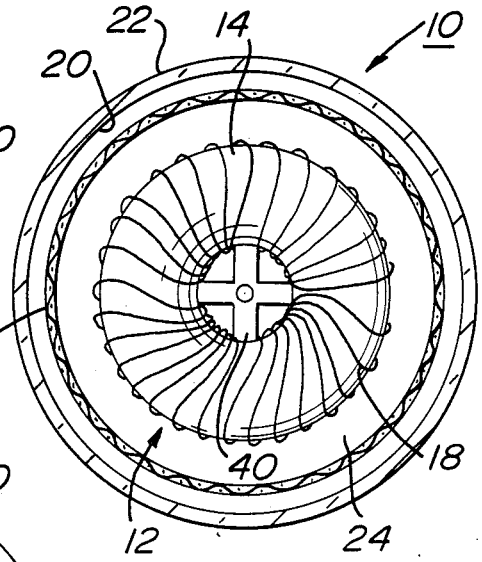
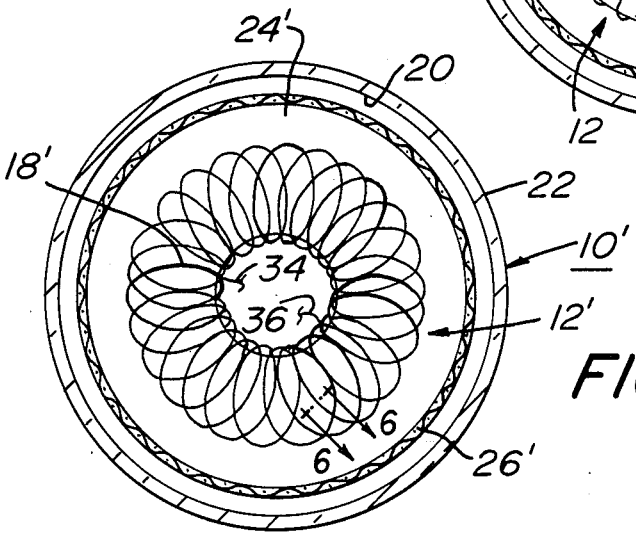
FIG. 3

FIG. 4
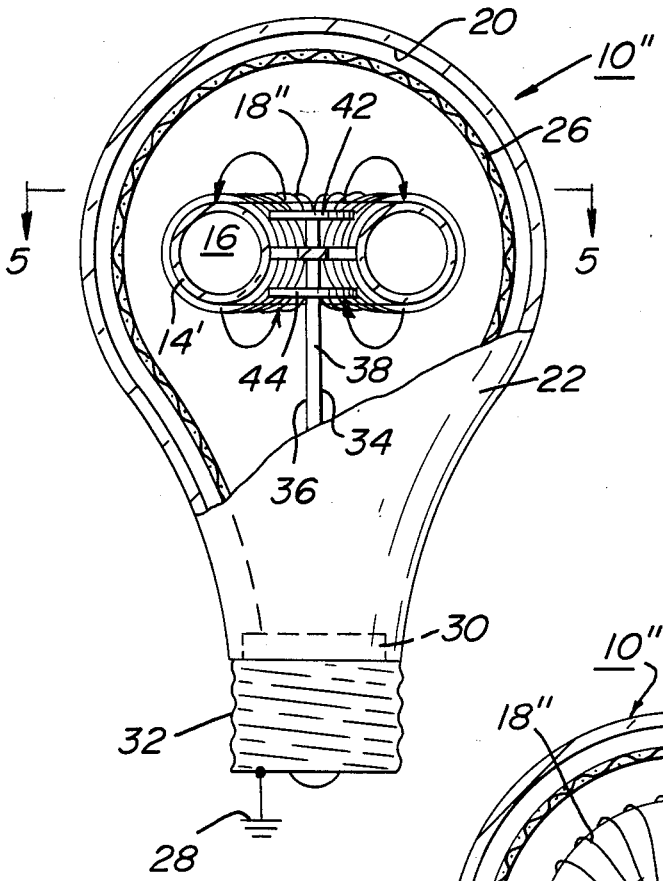
FIG. 5
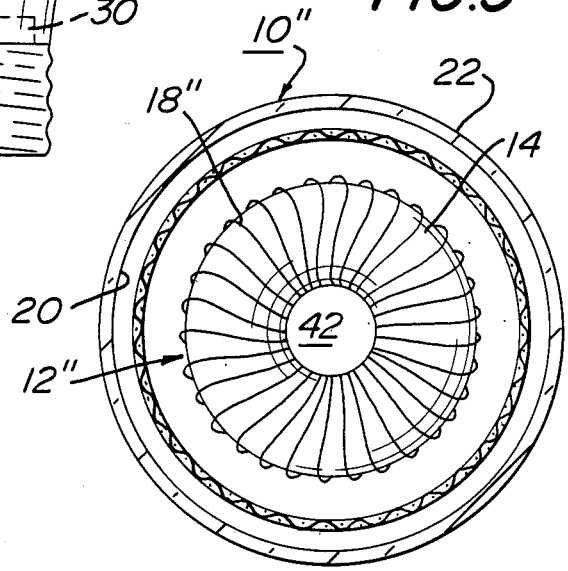
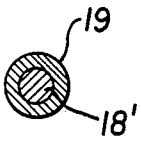
FIG. 6

ELECTRODELESS FLUORESCENT LIGHTING SYSTEM

BACKGROUND OF THE INVENTION

1. Field of the Invention

This invention pertains to lighting systems. In particular, this invention directs itself to fluorescent type lighting systems. More in particular, this invention relates to the conversion of ultraviolet radiation into the visible portion of the electromagnetic spectrum through impingement of the ultraviolet photons with a fluorescent coating. Still further, this invention relates to an electrodeless fluorescent type lighting system which utilizes an excitation mechanism for generating both an enclosed magnetic field and an induced electrical field which is substantially parallel and in the same direction as the magnetic field to accelerate electrons within a substantially closed volume for collision with gaseous composition atoms.

2. Prior Art

Fluorescent type lighting tubes are known in the prior art of lighting systems. In general, such prior art fluorescent type lighting systems include a mixture of noble gases such as neon, argon, and possibly a secondary gas such as mercury. Such prior art fluorescent tubes are generally provided with a pair of filament type electrodes which are coated with a material having the property of readily emitting electrons when heated. When electrical current is introduced to the prior art filament fluorescent light tubes, such filaments heat up and emit electrons with the filaments alternatively acting as an anode and a cathode. In such prior art fluorescent type tubes, extremely high voltages between the electrodes is necessitated in order to initiate the noble gas discharge. Thus, such prior art fluorescent lighting systems necessitate higher initial input of electrical energy and further necessitate the use of starters and ballasts for initiation of the self-sustaining discharge. Utilization of such systems provides for a complicated system and increases the cost expenditures for production of such prior art lighting systems.

In general, prior art fluorescent lighting systems require a fluorescent tube to be a generally linearly or arcuately extended cylindrical device of specified diameter. The diameters for such fluorescent tubes are selected for efficient operation. Thus, such prior art fluorescent tubes are restricted in their design as a function of operation efficiency. In opposition, the subject lighting system may be formed of a plurality of designs including spherical, cylindrical, or other design contour depending upon a particular application. The subject system is not bounded by the design criteria, since the subject system operates without electrodes and does not depend upon an electric field which extends from end to the other of a tubular structure, as is provided by the prior art systems.

In prior art fluorescent type lighting tubes, during each cycle of operation, the electrons flow in a single direction creating a concentration at one end of the prior art fluorescent tube which allows ions to recombine on the wall of the tube. Thus, such prior art systems provide for a limitation as to the minimum diameter since a very small diameter would increase the occurrence of the recombination of electrons with ions without the production of ultraviolet radiation.

Prior art fluorescent type systems are also limited in operating efficiency due to the re-absorption of ultraviolet radiation by the metallic gas composition material. As photons of ultraviolet radiation are emitted with the collision of electrons and ions, the photons may be attenuated by the metallic gas. Thus, the limitation is related to the distance that the photons must travel and this in effect limits the maximum diameter of such prior art fluorescent lighting systems. The re-absorption is a function of both the distance that the photons must travel and the gas pressure within the fluorescent lighting tubes.

In opposition, the subject lighting system is not bounded by the above-referenced limitation, as the recapturing of electrons by ions on the walls of the lighting system does not occur, since the collision between ions and electrons is maintained within a closed volume boundary.

REFERENCES TO RELATED PATENTS AND PATENT APPLICATIONS

U.S. Pat. No. 4,414,492 entitled "Electronic Ballast System" having the same inventor and Assignee as the subject invention, and U.S. patent application Ser. No. 580,624, filed Feb. 23, 1984, entitled "Self-Regulating Electronic Ballast System", and having the same inventor and Assignee as the subject invention, are both hereby incorporated by reference.

SUMMARY OF THE INVENTION

An electrodeless fluorescent lighting system is provided which includes an excitation mechanism for generating (1) an enclosed alternating magnetic field, (2) an induced electric field substantially parallel and in the same direction as the magnetic field, and, (3) a radiating electrical field passing substantially orthogonal to the enclosed magnetic field. The magnetic and induced electrical fields are applied at substantially the same frequency for accelerating and directing electrons for collision with predetermined gas composition atoms. An electrostatic shield member is included within the electrodeless fluorescent lighting system and substantially encompasses the excitation mechanism for containing the radiating electrical field within the lighting system. A bulb member encompasses the electrostatic shield member and the excitation mechanism. The bulb member includes a gas composition contained therein with the gas composition atoms being ionized by collision with the accelerated electrons. The gas composition ionized atoms radiate energy in the ultraviolet bandwidth of the electromagnetic spectrum subsequent to the collisions and impinge on a fluorescent material coating formed on an inner surface of the bulb member for absorbing at least a portion of the ultraviolet energy and re-radiating the absorbed energy external to the lighting system in the form of visible light.

BRIEF DESCRIPTION OF THE DRAWINGS

FIG. 1 is an elevational view, partially in cut-away showing the electrodeless lighting system;

FIG. 2 is a sectional view bf the electrodeless lighting system taken along the section line 2—2 of FIG. 1;

FIG. 3 is a sectional view of an embodiment of the electrodeless lighting system;

FIG. 4 is an elevational view of an embodiment of the electrodeless lighting system, showing a permanent magnet excitation mechanism;

FIG. 5 is a sectional view of the embodiment of the electrodeless lighting system taken along the Section Lines 5—5 of FIG. 4 and;

FIG. 6 is a sectional view of a coated toroidal coil.

DESCRIPTION OF THE PREFERRED EMBODIMENTS

Referring now to FIGS. 1 and 2, there is shown a preferred embodiment of the electrodelss fluorescent type lighting system 10 for producing visible light emission having a higher efficiency and extended operating lifetime when taken with respect to prior art lighting systems. The basic operating concept of lighting system 10 is directed to electron collision with gas composition atoms to produce ultraviolet radiation. The ultraviolet radiation isotropically is transported to a phosphor coating for impingement therewith resulting in re-emission of the ultraviolet radiation into the visible portion of the electromagnetic bandwidth.

In particular, electrodeless lighting system 10, as will be seen in following paragraphs, produces combined magnetic and electrical fields where the magnetic fields are each contained within a substantially closed volume. The combination of a magnetic field and an electrical field for focusing electrons has been successfully used in a number of applications, such as for the focusing of electrons in cathode ray tube applications. The concept of the subject invention directs itself to submitting electrons to the combination of forces developed by the induced electrical field and the magnetic field, in order to increase the probability of collisions of electrons with gas composition atoms over the probability of collision if an electron was being transported under the effect of only one of the fields resulting in a collision with only randomly moving gas composition atoms.

One of the main electrical disturbances in the external environment may result from the magnetic field produced. In order to obviate this type of disturbance, as will be seen in following paragraphs, the magnetic field interference is cancelled by enclosing the magnetic field in what is generally termed a magnetic bottle conceptually utilized in high acceleration particle devices. Lighting system 10 as will be shown operates at a relatively high frequency in the order of 10.0 MHz and the magnetic field produced if not contained and confined, would possibly disturb transmission telecommunication over a large area. As will be seen, radiated electrical field external effects are minimized by the introduction of an electrostatic shield internal to lighting system 10.

In prior art fluorescent light systems, there are provided two filaments that are operatingly alternatively as cathode and anode. Considering one-half cycle, electrons propagate in one direction and there is produced a concentrated field effect with the ultraviolet radiation of the contained plasma being a function of the diameter of the fluorescent tube. In such prior systems, metastable atoms and ions may recombine on the wall of the tube and such may capture portions of the electrons instead of recombining to produce radiation. In general, standard fluorescent tubes may have an overall efficiency within the range of 15%-20%. By confining the path and collision of the electrons within a substantially closed volume, lighting system 10 does not transport electrons to a tube or housing wall which would lower the visible light efficiency of the operating system, as is the case in standard fluorescent lighting systems.

In general, two phenomena which influence the lifetime of prior art fluroescent lighting systems direct themselves to the life of the filaments used which evaporate over an operating life cycle, as well as in the increase of deposits on the internal surface of the coating composition after a predetermined number of lighting operations. This latter phenomena is in part due to the deterioration of the gas pressure as the result of the continued bombardment by heavy particle ions and/or electrons.

Electrodeless fluorescent lighting system 10 includes excitation mechanism 12 for generating a permanent magnetic field, an enclosed magnetic field and an induced electrical field which is substantially parallel and in the same direction as the alternating magnetic field. The alternating magnetic and induced electrical fields are applied at substantially the same frequency for accelerating and directing electrons for collision with predetermined gas composition atoms contained within gas housing chamber 16 of closed contour gas housing 14. The alternating current flow at high frequency as previously described within overall toroidal coil 18 creates an electrical potential gradient between individual windings of coil 18. The electrical potential gradient obviously is created due to the increase and decrease of the current passing through the individual windings. The electrical potential gradient thus results in an electrical field substantially parallel to the magnetic field.

In overall concept, current passage through toroidal coil 18 creates both a magnetic and induced electrical field which accelerates and directs the electrons in a predetermined path for collision with gaseous composition atoms contained within gas housing chamber 16. The collision of electrons with metallic gas composition atoms contained within closed contour gas housing 14 and in particular, gas housing chamber 16 occurs internal within the confines of toroidal coil 18.

Ultraviolet radiation produced by such collisions is then radiated outward in all directions to ultimately be emitted as visible light, as will be described in following paragraphs. The collision of electrons with metallic gas ions contained within gas housing chamber 16 produces ultraviolet radiation which is radiated isotropically in an outward manner to strike phosphor coating 20 applied to the inner surface of bulb housing 22. Phosphor coating 20 or a like coating composition absorbs at least a portion of the ultraviolet energy impinging thereon and re-radiates the absorbed energy external to electrodeless lighting system 10 in the form of visible light.

As is clear, the gaseous plasma is contained within closed contour gas housing 14 within gas housing chamber 16 of electrodeless lighting system 10. The ultraviolet energy generated in the plasma passes through the substantially ultraviolet transparent excitation mechanism 12 to bombard coating 20 with ultraviolet radiation without producing any chemical reaction or structural degradation therein. As has been shown in prior paragraphs, this has the effect of increasing the operating lifetime of lighting system 10 as well as increasing the efficiency of lighting system 10 when taken with respect to prior art fluorescent lighting systems.

Additionally, excitation mechanism 12 as provided in the preferred embodiment of lighting system 10 shown in FIGS. 1 and 2 provides for a self-contained gas composition that is isolated atmospherically from bulb member 22 wherein a vacuum may be maintained within bulb member chamber 24 to minimize heat transfer effects from excitation mechanism 12 to the external environment.

The particular structure of excitation mechanism 12 essentially makes it independent of the temperature generated and such may be used at a higher pressure of gas contained within gas housing chamber 15 than prior art systems.

High pressure lighting systems are known which may be used for street lighting and other applications for emitting large quantities of light over large areas, however, in such high pressure systems, there still are contained cylindrical tubes where pressures may reach several atmospheres and provide very high intensity. The voltages applied in such high pressure lighting systems which are applied to start the tube and maintain the discharge, are extremely high and thus, the electrodes that have to be bombarded and that are submitted to the electrical field are immersed in the gas composition which deleteriously effects the life of such high pressure operating light systems.

In the subject electrodeless fluorescent lighting system 10, there is no metal composition internal to excitation mechanism 12, with the exception of the gas composition or possible metal composition formed as part of the closed contour gas housing 14. Thus, beyond these considerations, there is nothing in contact with the electrical field being generated. In lighting system 10, the vapor that is ionized and forms the plasma inside closed contour gas housing 14 is not in contact with the toroidal coil 18 and only contacts the internal envelope of gas housing chamber 16.

Excitation mechanism 12 includes toroidal coil 18 for generating the alternating magnetic and electrical fields. Additionally, closed contour gas housing 14 having a substantially donut contour is positionally located internal toroidal coil 18, as is shown in FIGS. 1 and 2. Electrical charge is passed through toroidal coil 18 in a helical direction as is evident by the coil contour shown in the Figures. The alternation of current within toroidal coil 18 creates an electrical potential gradient between the individual windings of coil 18 as current increases or decreases. This gradient induces an electric field substantially parallel to the magnetic field. The magnetic flux generated by toroidal coil 18 is contained totally within closed contour gas housing 14. The magnetic field that surrounds closed contour gas housing 14 maintains the electrons in a motion that is cyclical in nature internal to closed contour gas housing 14 which provides for an excited plasma circulating between the internal diameter and external diameter of gas housing 14. In this manner, there is a concentration of electrons and ions that are confined within gas housing 16 due to the magnetic field.

In order to maintain an efficiently operating system, electrodeless lighting system 10 operates at a relatively high frequency and allows for the generation of a high enough magnetic field to maintain and confine the path direction of the electrons circulating within gas housing chamber 16.

Experimentally, lighting system 10 has been efficiently operated at a frequency range in the order of 0.1–50.0 MHz and in one particular highly efficient operating embodiment, lighting system 10 has been operationally utilized at a frequency of 10.0 MHz.

The diameter of the conducting wire for the toroidal coil 18 is relatively small and the spacings between the individual coils of toroidal coil 18 is relatively large, in order that ultraviolet radiation which is generated within closed contour gas housing 14 is substantially unimpeded and unblocked by toroidal coil 18 in the ultraviolet radiation passage to coating composition 20 on the internal surface of bulb member or bulb housing 22. Individual coils of toroidal coil 18 may be formed of thin electrically conducting wire in the diameter range of 0.5 mm with spacing between the coils approximating 20.0 mm.

Gas housing 14 is formed of an ultraviolet radiation transparent composition which may be a glass composition. If a glass composition is used, the ultraviolet transparency would mean a glass composition deprived of iron. In order to have appreciable radiation, there must consequently be an appreciable cross-section of the plasma and in experimental operations, the cross-sectional area of gas housing chamber 16 has been varied between 0.75–1.0 square inches, wherein the internal and external radii of the donut shaped housing is varied between approximately 30.0–40.0 mm.

Closed contour gas housing 14 contains the predetermined gas composition which may be a metallic gas composition at some predetermined pressure. The predetermined gas composition may be Mercury, Argon, Neon, Sodium, or some like gaseous composition, and the pressure maintained within gas housing 14 has been successfully utilized at a pressure approximating 3.0 torr.

The donut shape of gas housing 14 is provided for illustrative purposes only. In fact, gas housing 14 may be square or rectangular in nature, however, it has been found difficult to manufacture a donut contour having a small internal radius compared to the diameter. In the subject lighting system 10, the overall donut contour may be formed in two separate portions. By molding pieces of glass forming semicircle, it is possible to provide two half donuts which may then be assembled each to the other by welding or some like technique such as fritted glass sealing.

Toroidal coil 18 is formed of a substantially highly electrically conductive metallic composition such as copper, silver, or some combination thereof. As has been previously stated, toroidal coil 18 is formed of a plurality of windings, with the windings being spaced apart each from the other by a predetermined distance in order to provide toroidal coil 18 to be substantially transparent to the ultraviolet radiation generated within gas housing chamber 16 of closed contour gas housing 14. The particular coupling of toroidal coil 18 to an electrical source will be discussed in following paragraphs.

The radiated electrical field generated by toroidal coil 18 radiates outwardly in all directions and may create a disturbing influence on various communication systems and similar electrical systems external to the bulb member 22. Thus, electrodeless fluorescent lighting system 10 includes electrostatic shield member 26 substantially encompassing excitation mechanism 12 for containing the radiated electrical fields within lighting system 10. Electrostatic shield member 26 substantially surrounds toroidal coil 18 to prevent egress of the radiated electrical field beyond the confines of lighting system 10.

Electrostatic shield member 26 may be formed from a perforated metallic material, such that photons of ultraviolet radiation may pass therethrough with little interference or reflection. Electrostatic shield member 26 is electrically coupled to ground 28 as is schematically shown in FIG. 1, in a direct coupling mode or in series through a capacitor.

Another type of electrostatic shield may be employed by providing a conductive coating on the exterior face of bulb member 22. A spray of tin chloride or some like composition may be used to externally coat bulb member 22 and thus contain the electrical field within lighting system 10. As was the case for electrostatic shield member 26, the conductive coating is coupled to ground 28 either directly or through a series coupled capacitor (not shown).

Thus, ultraviolet energy which is emitted from gas housing chamber 16 passes through ultraviolet radiation transparent gas housing 14, toroidal coil 18 and then through electrostatic shield member 26 to impinge upon fluorescent coating 20 formed on the internal surface of bulb member 22 for absorption and re-emission of energy in the visible bandwidth of the electromagnetic spectrum. Bulb member chamber 24 as has been stated is maintained at a high vacuum in order to minimize absorption of ultraviolet radiation and heat transfer effects and transmission from excitation mechanism 12 to the external environment.

Whereas prior art lighting systems require the generation of a high voltage in order to create a discharge within the enclosed gas composition of a tube, lighting system 10 uses a relatively low voltage and requires a current to pass through toroidal coil 18 to generate the required electrical and magnetic fields for generating sufficient energy to allow collisions between electrons and ions to occur within gas housing chamber 16 and generate the ultraviolet radiation. By operation of toroidal coil 18 at a high frequency, the voltage which is used to drive lighting system 10 is maintained at a minimum value and the current flowing in the coil 18 may be in the order of 1.0–3.0 amps. Toroidal coil 18 is coupled to ballast system 30 through leads 34 and 36 which are mounted on external surfaces of structural frame 38 formed of a dielectric material not important to the inventive concept as herein disclosed. Structural frame 38 may be formed of a vertically directed standard having lugs 40 radially directed and coupled to an internal surface of closed contour gas housing 14 to maintain such in a stationary location within bulb member 22. Electrical leads 34 and 36 are coupled on opposing ends to toroidal coil 18 and to ballast system 30 respectively.

Ballast 30 may be the ballast system shown in U.S. Pat. No. 4,414,492 entitled "Electronic Ballast System" as well as being similar to the ballast system shown in U.S. patent application Ser. No. 580,624, filed Feb. 23, 1984, and entitled "Self-Regulating Electronic Ballast System". Both of these systems are herein incorporated by reference.

Bulb member 22 encompasses electrostatic shield member 26 and excitation mechanism 12. Bulb member 22 includes a metallic gas composition contained therein and specifically within gas housing chamber 16. Gas composition atoms are ionized by collision with accelerated electrons provided by excitation mechanism 12 and the gas composition ionized atoms radiate energy in the ultraviolet bandwidth of the electromagnetic spectrum subsequent to such collisions whether the atoms are metastable or ions. The fluorescent material coating 20 is coated on an inner surface of bulb member 22 for absorbing at least a portion of the ultraviolet energy and re-radiating the absorbed energy external to lighting system 10 in the form of visible light. The radiating electric field generated by excitation mechanism 12 is limited in its radiating distance by electrostatic shield member 26 which prevents radiation passing external to lighting system 10.

In the embodiment shown in FIG. 3, electrodeless fluorescent lighting system 10' provides for bulb member 22 defining enclosing chamber 24'. In this embodiment, excitation mechanism 12' is only formed of toroidal coil 18' which generates a magnetic and electrical field wherein the electrical field is substantially parallel and in the same direction as the magnetic field due to the potential gradient between windings of coil 18', and is further contained within the internal envelope of toroidal coil 18'. In this embodiment, the electrons within the internal envelope of toroidal coil 18' are driven in a helical path and are accelerated for collision with predetermined gas composition atoms within the confines of the interior envelope formed by toroidal coil 18'. In accordance with classical electrodynamic theory, magnetic fields produced by toroidal coil 18' are contained within the toroid envelope. Thus, in the case of toroidal coil 18' the magnetic flux generated by toroidal coil 18' and the electrons flow within the space bounded by the windings themselves of toroidal coil 18'. The containment of the magnetic field is significant, in that it prevents radiation of the magnetic field external to lighting system 10'.

In this embodiment, enclosing chamber 24' contains a metallic gas composition. The metallic gas may be a mercury gas whose ions are attracted to the magnetic field generated within toroidal coil 18'. The electrical and magnetic fields generated by toroidal coil 18' increases the probability of collision between the electrons and the metallic gas ions over and above that which would occur from free electrons accelerated by a constant field gradient colliding with the metallic gas ions. Sufficient energy applied to these fields causes a radiation in the ultraviolet bandwidth of the electromagnetic spectrum when the collisions occur, as has been previously described for the preferred embodiment of lighting system 10. The radiating electric field generated by toroidal coil 18' is limited in its radiation distance by electrostatic shield 26' which is substantially the same member as provided for electrostatic shield 26 previously shown. Electrostatic shield member 26' may be a perforated electrically conductive metal composition or screen mesh composition wherein the perforations provide for a substantially transparent member when taken with respect to the ultraviolet radiation generated within the core of toroidal coil 18'. Phosphor coating 20 is provided on the inner surface of bulb member 22 for the absorption of the ultraviolet radiation and re-emission of that energy in the form of visible light.

In order to satisfy the skin effect, toroidal coil 18' may be manufactured from a wire whose composition is highly electrically conductive, such as copper, or silver wires. However, in the presence of mercury gas vapor, such highly conductive materials may absorb the mercury atoms over a period of time which would reduce the Mercury atoms in the gas composition and ultimately deleteriously affect the light output of lighting system 10'. As was seen in the preferred embodiment of the electrodeless fluorescent lighting system 10, such gaseous composition atoms are maintained internal to closed contour gas housing 14 and are not in contact with toroidal coil 18. However, in this embodiment, the gaseous composition atoms may come in contact with toroidal coil 18', and thus, such coil 18' may be manufactured of a highly electrically conductive wire which is covered with a dielectric material to prevent the absorption of the Mercury atoms. The plating or covering 19 as shown in FIG. 6, while insulating or at least not as conductive as the copper and/or silver toroidal coil composition does protect toroidal coil 18' from absorbing the Mercury atoms or molecules. Electrically, the high frequency resistance of toroidal coil 18' is substantially unaffected by the low conductivity plating since there is formed an equivalent circuit with two resistances in parallel, one extremely small and one relatively large, wherein the net effect is substantially equivalent to the lesser resistance, when the resistances are at least an order of magnitude apart in value. Thus, toroidal coil 18' may be a silver wire plated with iron or other insulating material to form coil 18' which is substantially unaffected by the Mercury gas composition within lighting system 10'.

Opposing ends of toroidal coil 18' are coupled to ballast 30 (as was shown for lighting system 10) through electrical leads 34 and 36. Electrostatic shield member 26' is similarly coupled to ground 28 through a lower portion of bulb member 22.

There has now been shown a method of providing visible light from lighting system 10, 10' which incorporates the utilization of excitation mechanism 12 for accelerating electrons in a predetermined path. The electrons are accelerated in a cyclical path within a substantially closed contour envelope through use of toroidal coil 18, 18' which accelerate the electrons in a circular donut shaped enclosure path.

The accelerated electrons are collided with atoms of a predetermined gas composition and such are ionized for releasing ultraviolet radiation. The ultraviolet radiation photons pass through toroidal coils 18, 18' and ultimately impinge on fluorescent material coating 20 where the ultraviolet violet radiation is re-emitted in the visible portion of the electromagnetic spectrum. The fluorescent material 20 is coated on an internal surface of bulb housing 22, which encompasses excitation mechanism 12.

The step of accelerating the electrons within the closed contour path includes the step of maintaining the electron path within a closed volume space defined by the internal envelope of the circular toroidal coil 18, 18'.

The step of maintaining the electron path further includes the step of generating an enclosed magnetic field and an electrical field which is substantially parallel and in the same direction as the enclosed magnetic field. By use of the donut shaped closed contour volume generated by toroidal coils 18, 18', the magnetic field is maintained internal to the closed donut shaped contour. Thus, by passing electrical current through toroidal coils 18, 18', electrons are cyclically driven through the internal donut shaped contour closed volume for impingement with predetermined gas composition atoms.

In the preferred embodiment shown in FIGS. 1 and 2, predetermined gas composition atoms are maintained within gas housing chamber 16 formed within closed contour gas housing 14. Toroidal coil 18 is wound around the external surface of closed contour gas housing 14. In this preferred embodiment, bulb member chamber 24 of bulb housing 22 is evacuated to produce a vacuum. Thus, accelerated electrons passing within donut shaped gas housing chamber 16 collide with gas composition atoms having a resulting ultraviolet radiation subsequent to ionization. The ultraviolet radiation passes through closed contour gas housing 14 which is formed of a substantially ultraviolet transparent composition, such as fused quartz glass.

Ultraviolet radiation then passes through electrostatic shield member 26 for impingement on fluorescent material or phosphor coating 20, which re-emits the impinging energy in the form of visible light.

In the embodiment shown in FIG. 3, the accelerated electrons are cyclically driven in a substantially circular path within the envelope formed by toroidal coil 18'. Toroidal coil 18', as was the case for toroidal coil 18, is formed of relatively thin wire wherein the individual coil members are spaced apart sufficiently to provide a substantially transparent member for passage therethrough of the ultraviolet radiation formed subsequent to the ionization of the gas composition atoms when collision with the accelerated electrons occur. In this embodiment, gas composition atoms are provided within bulb member chamber 24' however, collision generally only occurs within the volume internal to the donut shaped envelope formed by toroidal coil 18'.

In both of the embodiments shown in FIGS. 1 and 2, as well as FIG. 3, the step of ionizing the predetermined gas composition is followed by isotropically transporting the ultraviolet radiation to the tube fluorescent material 20 formed on the internal surface of bulb member or housing 22.

In both the preferred and secondary embodiments of lighting system 10, electrical shield 26 and 26' are provided which encompass excitation mechanisms 12 and 12' for providing an electrostatic shield barrier to the electrical field produced by excitation mechanisms 12 and 12'. Both electrical shield members 26 and 26' are formed of a mesh screen or perforated metal composition in order that such be substantially transparent to the ultraviolet radiation passing from excitation mechanisms 12 and 12' to fluorescent material coating 20 formed on an internal surface of bulb member 22.

Referring now to FIGS. 4 and 5, there is shown electrodeless lighting system 10'' which may either be an embodiment of electrodeless lighting system 10 or 10' shown in FIGS. 1, 2 and 3, respectively. Lighting system 10'' is based upon the concept that the current required to generate a predetermined magnetic field strength may be reduced by using a Vector sum of a constant magnetic field from permanent magnets aligned orthogonal to the enclosed magnetic field of coils 18 or 18'.

In the embodiment shown in FIGS. 4 and 5, excitation mechanism 12'' include permanent magnets 42 and 44 for establishing a constant magnetic field which is substantially orthogonal to the alternating magnetic field previously described. The permanent magnetic field thus sums vectorially with the alternating field to generate an increased field strength.

Thus, lighting system 10'' will have a predetermined magnetic field strength utilizing less current passing through the toroidal coil 18'' than would be provided for coils 18 and 18'.

For illustrative purposes, permanent magnet 42 may have a North pole located on one face and a South pole located on an opposing face of magnet 42. Permanent magnet 42 is located above the center line of the cross-section of gas housing enclosure 14' and within the center opening of the donut shape formed.

The magnetic faces of permanent magnet 42 are substantially parallel to the plane formed by the toroid. Permanent magnet 44 is mounted as a mirror image of permanent magnet 42 below the center line of the gas housing enclosure 14'. Permanent magnet 44 has its magnetic faces oriented in an opposing manner to that of magnet 42.

For illustrative purposes, permanent magnet 42 has its South pole facing permanent magnet 44. Correspondingly, permanent magnet 44 is then oriented in a manner such that its North pole faces magnet 42. This predetermined orientation of magnets 42 and 44 allows the magnetic field between the outside faces of magnets 42 and 44 to pass through the cross-section of the toroid formed by toroidal coil 18" or closed contour gas housing 14' in a manner such that the permanent magnet field is perpendicular to the field contained therein. Obviously, the magnetic circuit is completed by the magnetic field which is coupled between the magnetic poles of magnets 42 and 44 which opposingly face each other in the central opening of the general toroid contour.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or scope of the invention as defined in the appended claims.

What is claimed is:

1. An electrodeless fluorescent lighting system comprising:

(a) excitation means for generating (1) an enclosed magnetic field, (2) an induced electric field substantially parallel and in the same direction as said magnetic field, and (3) a radiating electric field orthogonal to said enclosed magnetic field, said magnetic and induced electrical fields being applied at substantially the same frequency for accelerating and directing electrons for collison with predetermined gas composition atoms, said excitation means including a toroidal coil for generating said magnetic and electrical fields and a closed contour gas housing having a substantially donut shaped contour positionally located internal said toroidal coil;

(b) an electrostatic shield member substantially encompassing said excitation means for containing said radiating electrical field within said lighting system;

(c) a bulb member encompassing said electrostatic shield member and said excitation means, said bulb member having said gas composition contained therein, said gas composition atoms being ionized by said collision with said accelerated electrons, said gas composition ionized atoms for radiating energy in the ultraviolet bandwidth of the electromagnetic spectrum subsequent to said collisions; and, (d) a fluorescent material coating an inner surface of said bulb member for absorbing at least a portion of said ultraviolet energy and reradiating said absorbed energy external said lighting system in the form of visible light.

2. The electrodeless fluorescent lighting system as recited in claim 1 where said induced electric field of said excitation means accelerates said electrons and said magnetic field of said excitation means directs said electrons in a predetermined helical path.

3. The electrodeless fluorescent lighting system as recited in claim 1 including permanent magnet means for establishing a substantially constant magnetic field substantially passing orthogonal said enclosed magnetic field.

4. The electrodeless fluorescent lighting system as recited in claim 3 where said permanent magnet means includes a pair of disc shaped magnets positionally located substantially within an internal diameter of said donut contour of said closed contour gas housing.

5. The electrodeless fluorescent lighting system as recited in claim 1 where said closed contour gas housing has said predetermined gas composition contained therein.

6. The electrodeless fluorescent lighting system as recited in claim 5 where said predetermined gas composition includes a metallic gas composition.

7. The electrodeless fluorescent lighting system as recited in claim 6 where said predetermined gas composition is maintained within said closed contour gas housing at a predetermined pressure.

8. The electrodeless fluorescent lighting system as recited in claim 7 where said predetermined gas composition includes at least one noble gas composition.

9. The electrodeless fluorescent lighting system as recited in claim 8 where said metallic gas composition is Mercury.

10. The electrodeless fluorescent lighting system as recited in claim 1 where said closed contour gas housing is formed of an ultraviolet radiation transparent material composition.

11. The electrodeless fluorescent lighting system as recited in claim 10 where said ultraviolet radiation transparent material is a quartz composition.

12. The electrodeless fluorescent lighting system as recited in claim 10 where said closed contour gas housing is formed of an ultraviolet radiation transparent glass composition.

13. The electrodeless fluorescent lighting system as recited in claim 1 where said toroidal coil is formed of a substantially high electrically conductive metallic composition.

14. The electrodeless fluorescent lighting system as recited in claim 13 where said coil metallic composition is copper.

15. The electrodeless fluorescent lighting system as recited in claim 13 where said coil metallic composition is silver.

16. The electrodeless fluorescent lighting system as recited in claim 13 where said coil metallic composition is formed of at least one element from the group consisting of copper and silver.

17. The electrodeless fluorescent lighting system as recited in claim 1 where said toroidal coil is formed of a plurality of windings, said windings spaced apart each from the other a predetermined distance for providing said toroidal coil to be substantially transparent to said ultraviolet radiation.

18. The electrodeless fluorescent lighting system as recited in claim 1 where said electrostatic shield is formed of an electrically conductive material composition.

19. The electrodeless fluorescent lighting system as recited in claim 18 where said electrostatic shield member is perforated for allowing passage therethrough of ultraviolet radiation.

20. The electrodeless fluorescent lighting system as recited in claim 19 where said electrostatic shield is electrically coupled to ground.

21. The electrodeless fluorescent lighting system as recited in claim 1 including ballast means coupled to said excitation means for driving said excitation means.

22. The electrodeless fluorescent lighting system as recited in claim 1 where said bulb member defines an enclosing chamber, said electrostatic shield, excitation means and said predetermined gas composition being located within said enclosing chamber.

23. The electrodeless fluorescent lighting system as recited in claim 22 where said toroidal coil is formed of a plurality of windings formed of a substantially high electrically conductive metallic composition.

24. The electrodeless fluorescent lighting system as recited in claim 22 where said toroidal coil is metallically plated.

25. The electrodeless fluorescent lighting system as recited in claim 24 where said toroidal coil is formed of a metal composition containing at least one element from the group consisting of copper and silver.

26. The electrodeless fluorescent lighting system as recited in claim 24 where said toroidal coil metallic plating is formed of a dielectric composition.

27. The electrodeless fluorescent lighting system as recited in claim 24 where said toroidal coil includes an electroplated film of iron.

28. The electrodeless fluorescent lighting system as recited in claim 23 where each of said toroidal coil windings are spaced apart from a next successive coil winding by a predetermined distance sufficient to maintain said toroidal coil substantially transparent to ultraviolet radiation energy passing therethrough.

29. The electrodeless fluorescent lighting system as recited in claim 23 where said toroidal coil is electrically operable at a predetermined frequency within the approximate operating range of 0.1 to 50.0 Megahertz.

30. The electrodeless fluorescent lighting system as recited in claim 29 where said predetermined operating frequency of said toroidal coil approximates 10.0 Megahertz.

31. The electrodeless fluorescent lighting system as recited in claim 22 where said electrostatic shield is formed of an electrically conductive material composition.

32. The electrodeless fluorescent lighting system as recited in claim 31 where said electrostatic shield electrically conductive material is perforated.

33. The electrodeless fluorescent lighting system as recited in claim 31 where said electrostatic shield is formed of an electrically conductive screen member.

34. The electrodeless fluorescent lighting system as recited in claim 31 where said electrostatic shield is electrically coupled to ground.

35. The electrodeless fluorescent lighting system as recited in claim 22 where said predetermined gas composition is a metallic gas composition.

36. The electrodeless fluorescent lighting system as recited in claim 35 where said metallic gas composition is maintained within said enclosure chamber at a predetermined pressure.

37. The electrodeless fluorescent lighting system as recited in claim 35 where said metallic gas composition is Mercury.

38. The electrodeless fluorescent lighting system as recited in claim 1 where said fluorescent material is formed of a phosphor composition.

39. The electrodeless fluorescent lighting system as recited in claim 38 including ballast means coupled to said toroidal coil for electrically driving said toroidal coil at a predetermined frequency.

40. The electrodeless fluorescent lighting system as recited in claim 1 including permanent magnet means positionally located adjacent said excitation means for increasing the field strength of said enclosed magnetic field.

* * * * *